US005112218A

United States Patent [19]

Sigler

[11] Patent Number: 5,112,218

[45] Date of Patent: May 12, 1992

[54] BURNER CONSTRUCTION, IGNITER ASSEMBLY THEREFOR AND METHODS OF MAKING THE SAME

[75] Inventor: Kent K. Sigler, Youngwood, Pa.

[73] Assignee: RobertShaw Controls Company, Richmond, Va.

[21] Appl. No.: 759,217

[22] Filed: Sep. 13, 1991

[51] Int. Cl.[5] ..... F23Q 3/00

[52] U.S. Cl. ..... 431/266; 431/354; 126/39 E

[58] Field of Search ..... 431/263, 264, 266

[56] References Cited

U.S. PATENT DOCUMENTS

| | | | |
|---|---|---|---|
| 4,846,671 | 7/1989 | Kwiatek | 431/266 |
| 5,002,038 | 3/1991 | Riehl | 126/39 R |
| 5,040,970 | 8/1991 | Riehl | 431/266 |

FOREIGN PATENT DOCUMENTS 2408096 2/1977 France .

OTHER PUBLICATIONS

Allowed copending patent application, Ser. No. 508,799, filed Apr. 12, 1990.

*Primary Examiner*—Carroll B. Dority

*Attorney, Agent, or Firm*—Candor, Candor & Tassone

[57] ABSTRACT

A burner construction, igniter assembly therefor and methods of making the same are provided, the igniter assembly comprising an electrically insulating body member having an intermediate portion and having opposed end surfaces one of which is adapted to be disposed adjacent a cap of a burner construction, and an electrically conductive L-shaped electrode carried by the body member and having two legs one of which extends out of the intermediate portion thereof for sparking to the cap and the other of which extends out of the other of the opposed end surfaces of the body member for electrical connection purposes, the body member comprising a one-piece member, the two legs of the electrode initially comprising two separate parts having adjacent ends that have now been secured together inside the body member.

4 Claims, 4 Drawing Sheets

BURNER CONSTRUCTION, IGNITER ASSEMBLY THEREFOR AND METHODS OF MAKING THE SAME

BACKGROUND OF THE INVENTION

1. Field of the Invention

This invention relates to a new burner construction and to a new igniter assembly for a burner construction as well as to new methods of making such a burner construction and such an igniter assembly.

2. Prior Art Statement

It is known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by a plurality of radially disposed groove means that are spaced apart by land means of the annular surface means, the cap means having an annular surface means cooperating with the annular surface means of the body means to close the groove means on one end thereof whereby the groove means define the port means, the body means having an igniter receiving slot means therein, and an igniter assembly having a part thereof disposed in the slot means, the igniter assembly comprising an electrically insulating body member having an intermediate portion and having opposed end surface means one of which is disposed adjacent the cap means, and an electrically conductive L-shaped electrode means carried by the body member and having two legs one of which extends out of the intermediate portion thereof for sparking to the cap means and the other of which extends out of the other of the opposed end surface means of the insulating body member for electrical correction purposes. For example, see the allowed copending patent application, Ser. No. 508,799, filed Apr. 12, 1990 and now patent No. 5,040,970.

Also, see the U.S. patent to Riehl, No. 5,002,038, for a similar burner construction and an igniter assembly.

Also, see the U.S. patent to Kwiatek, No. 4,846,671, and the French patent to Sourdillon, No. 2,408,096, for other similar burner constructions and igniter assemblies.

SUMMARY OF THE INVENTION

It is one feature of this invention to provide a new burner construction that has a unique igniter assembly.

In particular, it was found according to the teachings of this invention that the igniter assembly for a burner construction can have an L-shaped conductive electrode carried by a one-piece electrically insulating body member that has opposed end surface means and an intermediate portion from which one leg of the electrode extends for sparking purposes while the other leg extends out of one of the end surface means for electrical connection purposes, the two legs of the electrode initially comprising two separate parts having adjacent ends that are secured together inside the body member.

For example, one embodiment of this invention comprises a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, the body means having an annular surface means interrupted by the plurality of radially disposed groove means that are spaced apart by land means of the annular surface means, the cap means having an annular surface means cooperating with the annular surface means of the body means to close the groove means on one end thereof whereby the groove means define the port means, the body means having an igniter receiving slot means therein, and an igniter assembly having a part thereof disposed in the slot means, the igniter assembly comprising an electrically insulating body member having an intermediate portion and having opposed end surface means one of which is disposed adjacent the cap means, and an electrically conductive L-shaped electrode means carried by the body member and having two legs one of which extends out of the intermediate portion thereof for sparking to the cap means and the other of which extends out of the other of the opposed end surface means of the insulating body member for electrical connection purposes, the body member comprising a one-piece member and the two legs of the electrode means initially comprising two separate parts having adjacent end means that have now been secured together inside the body member.

Accordingly, it is an object of this invention to provide a new burner construction having one or more of the novel features of this invention as set forth above or hereinafter shown or described.

Another object of this inventnion is to provide a new method of making such a burner construction, the method of this invention having one or more of the novel features of this invention as set forth above or hereinafter shown or described.

Another object of this invention is to provide a new igniter assembly for a burner construction, the igniter assembly of this invention having one or more of the novel features of this invention as set forth above or hereinafter shown or described.

Another object of this invention is to provide a new method of making such an igniter assembly, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
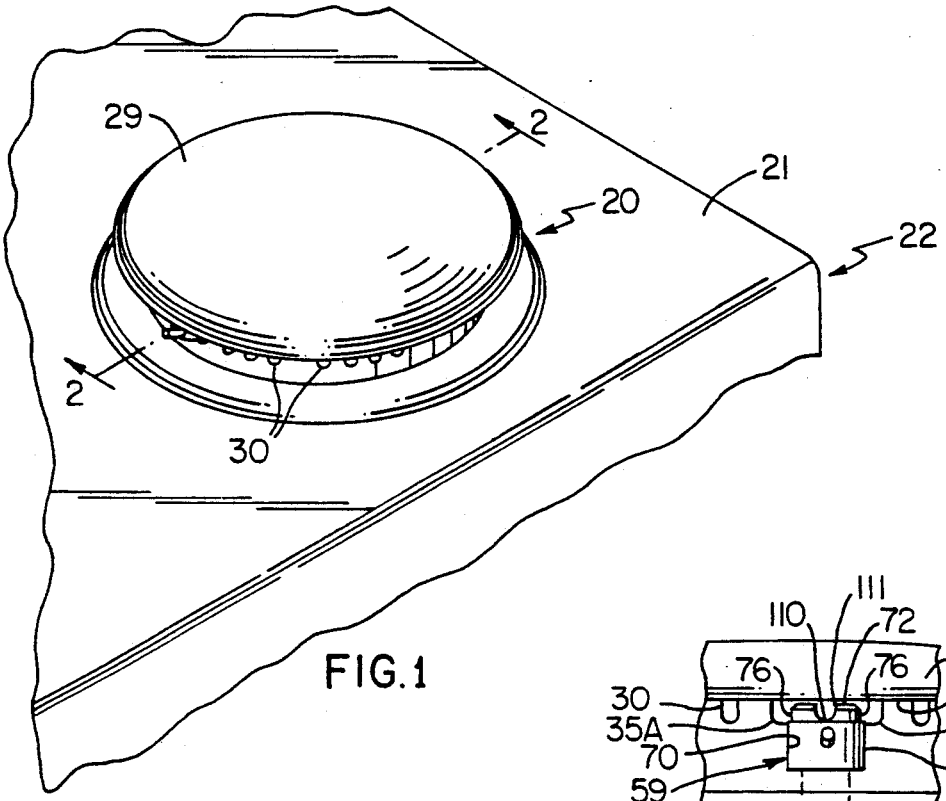
FIG. 1 is a fragmentary top perspective view illustrating the new burner construction of this invention mounted in a range top of a cooking apparatus.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiment illustrated in the drawings, because the drawings are merely utilized to illustrate one of the wide variety of uses of this invention.

The burner construction of this invention is of a type that is similar to the burner constructions that are set forth in the aforementioned allowed copending patent application, Ser. No. 508,799, filed Apr. 12, 1990, now Pat. No. 5,040,970 , and the U.S. patent to Riehl, No. 5,002,038, whereby this allowed copending patent application and this issued patent are respectively being incorporated into this disclosure by this reference thereto. However, since the igniter assembly of this invention has unique features over the igniter assemblies of the prior mentioned copending patent application and issued patent, certain of the details of the burner construction of this invention that are believed necessary to understand the features of this invention will now be set forth.

Referring now to FIGS. 1-4, the new burner construction of this invention is generally indicated by the reference numeral 20 and is illustrated in FIG. 1 as being sealed to the range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a fuel source 28 with the chamber means 24 in a manner hereinafter set forth.

The burner construction 20 also comprises a removable cap means 29 closing the open end means 25 of the burner body means 23, the burner construction 20 having a plurality of port means 30 interconnecting the chamber means 24 to the exterior of the burner construction 20 and through which fuel can issue to burn externally to the burner construction 20 in a manner well known in the art. For example, not only see the aforementioned allowed copending patent application, Serial No. 508,799, filed Apr. 12, 1990, and the aforementioned U.S. patent to Riehl, No. 5,002,038, but also see the aforementioned U.S. Patent to Kwiatek, No. 4,846,671, and the aforementioned French patent to Sourdillon, No. 2,408,096, whereby these last two patents are also being incorporated into this disclosure by this reference thereto.

While the burner body means 23 and removable cap means 29 of the burner construction 20 of this invention can be formed of any suitable material or combination of materials, such as metallic material, one working embodiment thereof has the body means 23 and cap means 29 each formed of die cast aluminum RMS-105 whereby the two main parts of the burner construction 20, namely the burner body means 23 and cap means 29, can be manufactured as two castings without machine processes and thereby having a reduced manufacturing cost.

Figure 4:
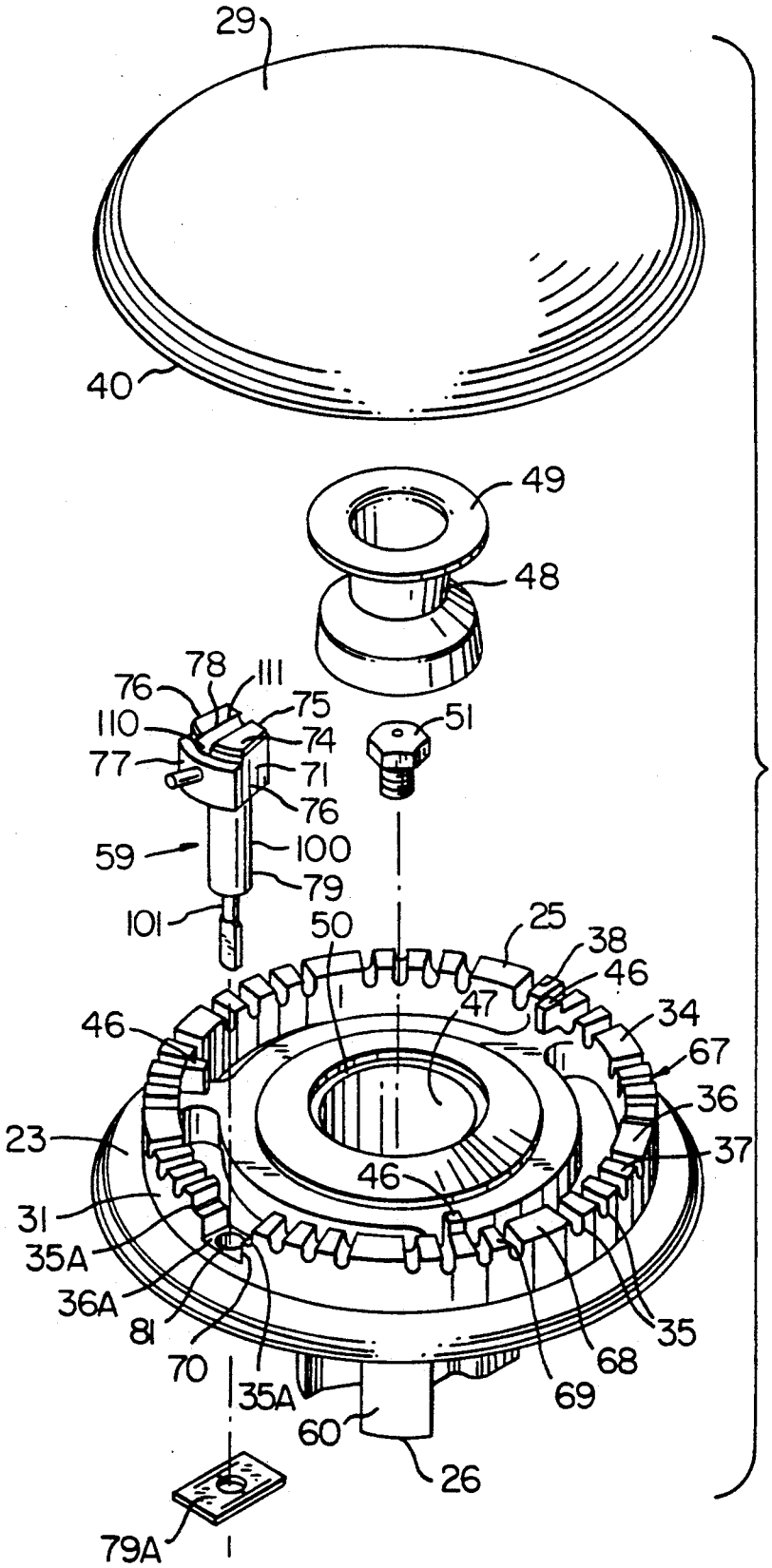
FIG. 4 is an exploded perspective view of the various parts of the burner construction of FIGS. 1-3.
Figure 5:
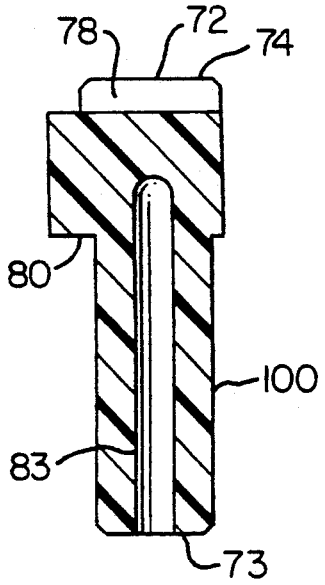
FIG. 5 is an enlarged cross-sectional view of the body member of the igniter assembly of this invention, FIG. 5 illustrating the body member after the initial molding thereof.

The body means 23 has an annular wall 31 provided with an annular substantially flat top surface 34 interrupted by a plurality of radially disposed and spaced apart U-shaped grooves 35 disposed in the circular array pattern as illustrated in FIGS. 4 and 5, the groove means 35 being separated by ungrooved land means 36 and 37 of the annular surface means 34 in a unique patterned arrangement that will be hereinafter set forth.

Figure 3:
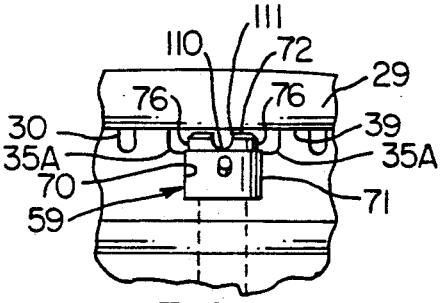
FIG. 3 is a fragmentary view looking toward the igniter assembly of the burner construction of FIG. 2, FIG. 3 being taken generally in the direction of the arrows 3—3 of FIG. 2.
Figure 2:
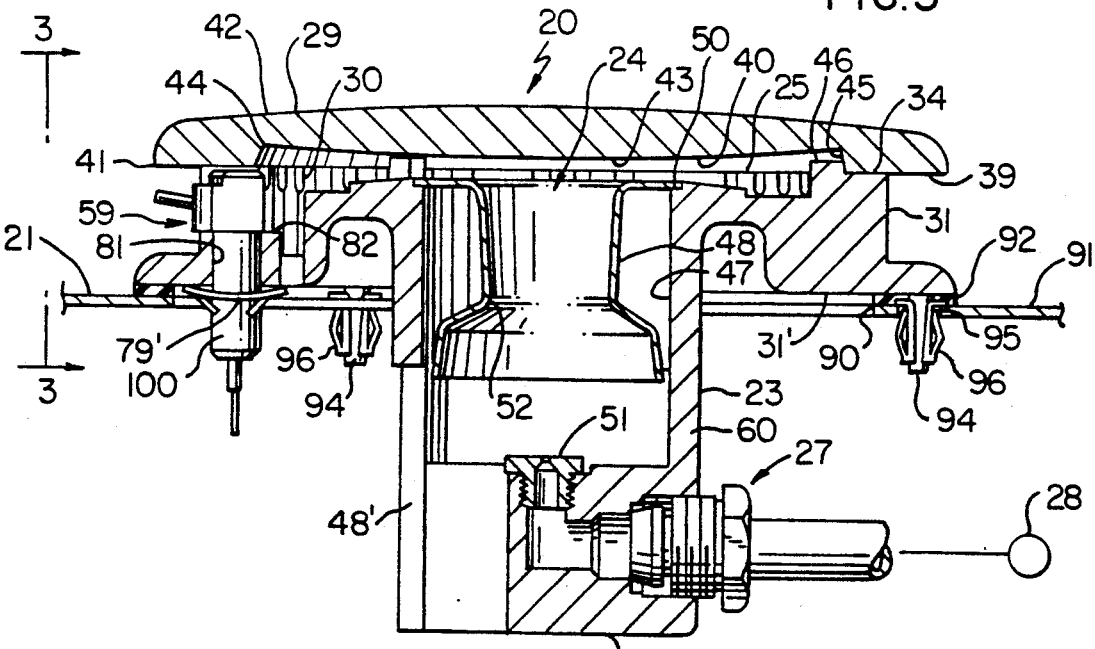
FIG. 2 is an enlarged fragmentary cross-sectional view taken on line 2—2 of FIG. 1.
Figure 10:
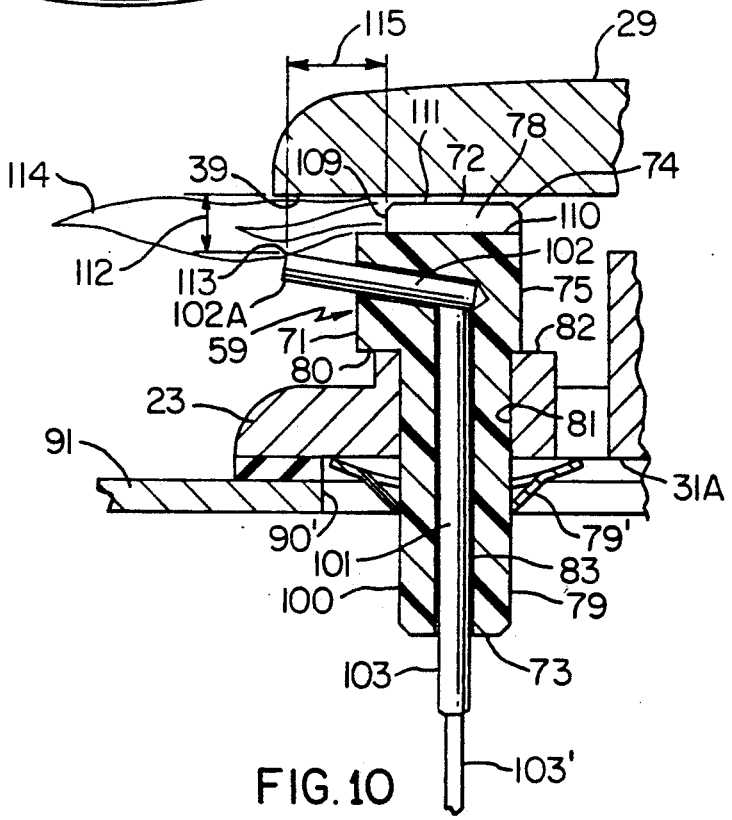
FIG. 10 is an enlarged fragmentary cross-sectional view of the burner construction and is taken on line 10—10 of FIG. 9.

The grooves 35 in the body member 23 are adapted to be closed at the open ends 38 thereof by a substantially flat annular surface means 39 formed on a side 40 of the cap means 29 when the cap means 29 is disposed in its closing position on the open end 25 of the body means 23 in the manner illustrated in FIGS. 2, 3 and 10 so as to cooperate with the grooves 35 to define the port means 30 previously set forth.

The cap means 29 has an annular peripheral edge means 41 that interconnects the side 40 of the cap means 29 with an opposed side 42 thereof, the side 42 being generally conical and the side 40 also having a central conical portion 43 that has its larger base 44 joining with the flat annular portion 39 by an angled surface means 45 which is adapted to engage against a plurality of upwardly standing abutments 46 of the body member 23 so as to orient the cap 29 in its rotational position on the end 25 of the body means 23 so that the annular surface means 39 thereof will close the U-shaped grooves 35 to form the ports 30 as previously set forth.

The chamber means 24 of the body member 23 has a cylindrical portion 47 in which a removable venturi member 48 is disposed and has an upper annular flange means 49 that rests on an annular shoulder 50 of the body means 23 as illustrated in FIG. 2 so that the flow of fuel out of an orifice means 51 must pass through a throat 52 of the venturi member 48 before the same can reach the chamber means 24 to pass out through the ports 30 all for the reasons fully set forth in the aforementioned U.S. patent to Riehl, No. 5,002,038, the flow of fuel through the venturi member 48 drawing primary air through the opening means 48' in the wall 47 to mix with the fuel also in a manner well known in the art.

The groove means 35 that are formed in the wall 31 of the burner body means 23 to subsequently form the port means 30 are so constructed and arranged that the same define a substantially repeating pattern of a set 67 of four grooves 35 separated from each other by land means 37 and then separated from the next set 67 of four grooves 35 and their intermediate land means 37 by a large land means 36 that has an annular length or circumferential length greater than the annular or circumferential length of each of the lands 37 of the two adjacent sets 67 as illustrated. In addition, the separating lands 36 each has a free end flat surface 68 that is recessed below the free end flat surfaces 69 of the lands 37 so as to provide for carry-over flame means between each set 67 of port means so that once ignition of fuel issuing from one or more port means 30 is accomplished by an igniter assembly 59 of this invention in the manner hereinafter set forth, flame propagation will be provided completely around the burner body means 23 at each port means 30 thereof.

One of the larger land means 36 of the burner construction 20 of this invention is indicated by the reference numeral 36A in FIG. 4 and one of the legs of the groove means 35A on each side of the land means 36A are cut away to form a substantially truncated triangular slot means 70 therein to receive an enlarged substantially truncated triangular intermediate portion 71 of the igniter assembly 59 therein in the manner illustrated in FIGS. 2, 3, 9 and 10 and hereinafter set forth.

It has been found in one working embodiment of the burner construction 20 of this invention wherein the width of the annular surface 34 of the wall 31 of the burner body means 23 is slightly greater than approximately 0.250 of an inch, the grooves 35 each can have a width at the open end 38 thereof of approximately 0.062 of an inch and a depth of approximately 0.115 of an inch while the U-shaped end thereof is defined by a radius that is ½ of the width of the respective groove 35. The outer surfaces 68 of the separating lands 36 are each recessed below the outer surfaces 69 of the lands 37 by approximately 0.015 of an inch while the annular or circumferential length of the surface 68 of each of the separating lands is approximately 0.315 of an inch and the annular or circumferential length of the surface 69 of each land 37 is approximately 0.125 of an inch.

While the burner body means 23 of the burner construction 20 of this invention can be mounted to the top surface means 21 of the cooking apparatus 22 in any suitable manner, the embodiment of the burner construction 20 illustrated in the drawings is adapted to have a lower portion 60 of the burner body means 23 inserted through a suitable circular opening 90 formed through a top wall 91 of the cooking apparatus 22 that has the top surface means 21 as illustrated in FIG. 2 and be sealed thereto by a conventional annular sealing means 92 so as to space the lower surface 31' of the burner body means 23 slightly above the top surface 21 of the wall means 91 in order to prevent heat of the burner construction 20 from being transferred by conduction to the wall 91 through intimate contact with the metallic material of the burner construction 20 with the wall means 91.

The wall means 31 of the burner body 23 has a plurality, such as three, tapering projections 94 formed integrally therewith and extending downwardly therefrom so as to be adapted to pass through cooperating openings 95 through the wall 91 at the time that the portion 60 of the burner body means 23 is being inserted through the large opening 90, the projections 94 being held in the inserted position thereof by conventional spring clip means 96 in a conventional manner for such type of clip means and as set forth in the aforementioned allowed copending patent application No. 508,799, filed Apr. 12, 1990.

The unique igniter assembly 59 of this invention comprises a one-piece electrically insulating body member 100 formed of any suitable material, such as a suitable ceramic material known as L3 Steatite, and has the enlarged intermediate portion 71 and opposed end surface means 72 and 73. The intermediate part 71 has a generally truncated triangular configuration having a smaller base of side 75, angled sides 76 and an arcuate larger base or side 77. A top portion 74 is provided on the intermediate portion 71 and extends from the rear edge 75 toward the front edge 77 while being interrupted by a U-shaped groove or slot 78 that extends from the smaller base 75 toward the larger base 77 substantially centrally through the top portion 74 as illustrated.

The body member 100 of the igniter assembly 59 has a cylindrical or post-like portion 79 extending from a lower surface 80 of the enlarged intermediate portion 71 as illustrated and is adapted to pass down through a circular opening 81 formed through a surface 82 of the burner body means 23 created by the slot 36A as illustrated so that the lower surface 80 of the body 100 will rest against the surface 82 in the manner illustrated in FIG. 10 while the angled sides 76 of the enlarged portion 71 cooperate with the grooves 35A to complete the missing legs thereof in the manner illustrated in FIG. 3 so that fuel can flow out of the grooves 35A on each side of the igniter assembly 59 in generally the same amount and with generally the same flow rate as the fuel issuing out of the other ports 30 of the burner construction 20.

In order to mount the igniter assembly 59 in place, a spring clip 79' can be telescopically disposed on the portion 79 of the body member 100 to engage against the underside 31' of the burner body means 23 as illustrated in FIG. 10 and the wall 91 of the cooking apparatus 22 can be provided with a suitable opening 90' to not only receive the cylindrical portion 79 of the igniter assembly 59 therethrough, but also the spring clip means 79' as illustrated in FIG. 10.

The body member 100 of the igniter assembly 59 has an opening 83 passing substantially centrally through the cylindrical portion 79 thereof to join at one end thereof with another opening 84 that interrupts the intermediate portion 71, the openings 83 and 84 being substantially straight and making an obtuse angle with each other.

Figure 6:
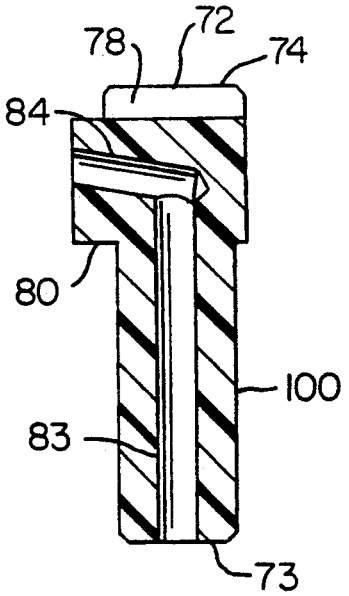
FIG. 6 is a view similar to FIG. 5 and illustrates the body member of FIG. 5 after a hole has been drilled therein.

The opening 83 in the body member 100 is formed at the same time the body member 100 is being cast or molded as illustrated in FIG. 5 and then the opening 84 is drilled into the body member 100 as illustrated in FIG. 6.

Figure 7:
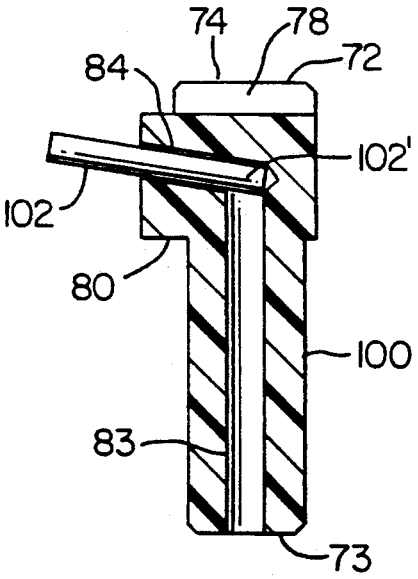
FIG. 7 is a view similar to FIG. 6 and illustrates the body member after one of the legs of the electrode means has been assembled therein.
Figure 8:
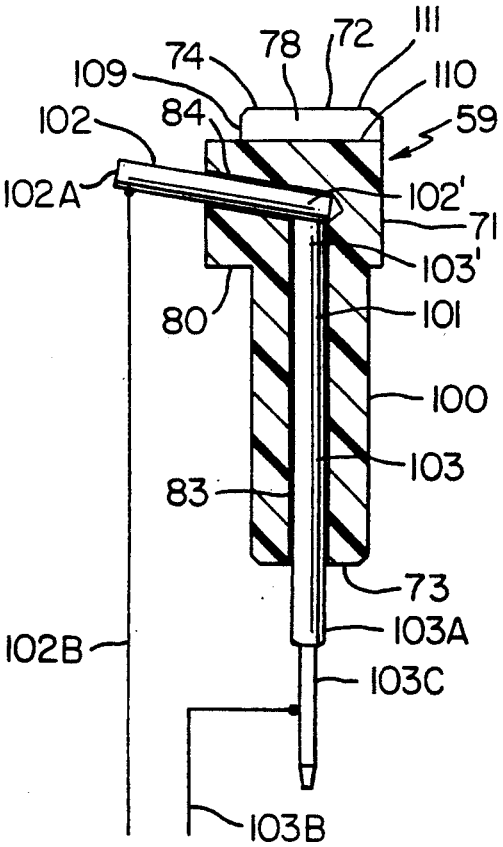
FIG. 8 is a view similar to FIG. 7 and illustrates the body member after the other leg of the electrode means has been assembled therein, FIG. 8 also schematically illustrating the resistance welding means for securing the two legs assembled together inside the body member.
Figure 9:
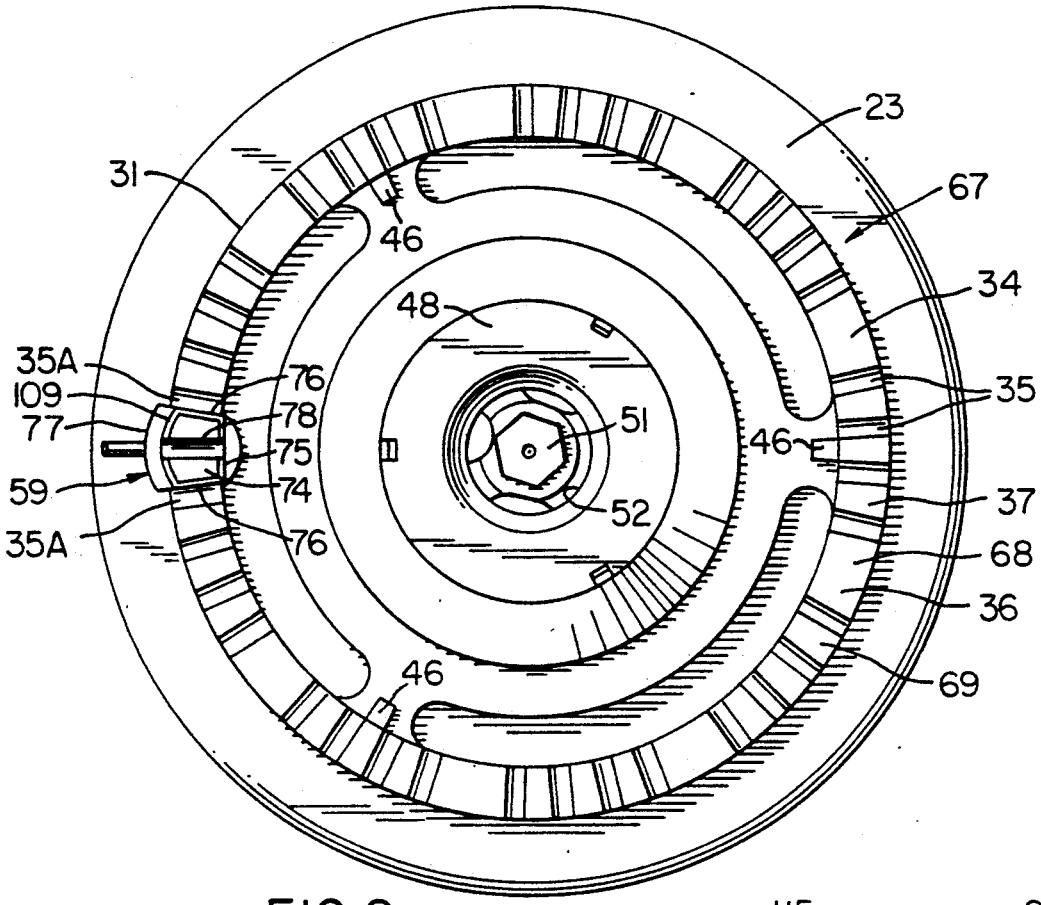
FIG. 9 is a cross-sectional view of the burner construction of FIG. 2 and is generally taken in the direction of the arrows 9—9 of FIG. 2.

The igniter assembly 59 also includes an L-shaped conductive electrode means 101 formed of any suitable metallic material and initially having two separate parts or legs 102 and 103 disposed in respective openings 83 and 84 in the sequence of FIGS. 7 and 8 with the adjacent end means 102' and 103' thereof disposed in abutting relation.

Thereafter, a suitable resistance welding apparatus (not shown) is electrically interconnected to the outwardly projection parts 102A and 103A of the legs 102 and 103 by the leads 102B and 103B to resistance weld the legs together at the abutting adjacent end means 102' and 103' when a suitable electrical current is passed through the legs 102 and 103 in a manner well known in the art.

It can be seen that the outwardly projecting portion 102A of the leg 102 is angled upwardly for a purpose hereinafter set forth.

In one working embodiment of the igniter assembly 59 of this invention, the legs 102 and 103 of the electrode means 101 each comprises a stainless steel wire or rod that is approximately 0.062 of an inch in diameter and initially the leg 103 has a length of approximately 1.777 inches and with the leg 102 being approximately 0.477 of an inch in length. The leg 102 is angled at an obtuse angle of approximately 96° with the leg 103 and the leg 103 has a flattened portion 103C for lead attachment purposes.

In the one working embodiment of this invention, the legs 102 and 103 are resistance welded together with a resistance welding apparatus sold as Model 6100T, 10KVA, 220VAC Synchronous Power Supply with Model 502 Programmable Weld Control by Semtorq, Inc., of Bedford, Ohio, the legs 102 and 103 being placed together under 17 to 22 pounds of weld force during such resistance welding with a current value of approximately 1.8 to 2.5 KW for about 15 seconds.

The slot means or groove means 78 that is formed in the end surface means 72 of the body member 100 has a substantially round bottom wall 110 and an upper open end 111 that is substantially closed by the annular surface 39 of the cap means 29 in the manner illustrated in FIG. 10 so that fuel will issue from the chamber means 24 of the burner construction 20 out through the slot means 78 to be disposed in a spark gap 112 defined between a tip 113 of the projecting part 102A of the leg 102 of the electrode 101 and the surface 39 of the cap means 29 so as to be ignited by sparking that is created between the electrode means 101 and the cap means 29 and thereby create the ignition flames 114 which will then through flame propagation ignite the fuel issuing from the adjacent port means 35A and the subsequent adjacent port means 30 all in a manner well known in the art.

In this manner, it has been found that the groove or slot means 78 assures a metered fuel flow into the area 112 of the ignition sparks so as to assure a combustible fuel mixture that will ignite in four seconds maximum and assure that this charge point flame 114 will also envelop the igniter electrode and 102A in such a manner as to provide flame rectification of the probe with any flame size that will burn in a reliable manner as it is well known that the ignition of a top burner by spark discharge is very difficult when subjected to all fuel types, burner ratings and gas pressures required.

However, it has been found that the igniter assembly 59 of this invention performs under practically all ignition and flame rectification conditions successfully without requiring close manufacturing tolerances which makes it possible to produce the igniter assembly 59 by using ceramic components as provided by standard product vendors.

In particular, it has been found that successful ignition has been obtained using a spark electrode gap 112 of approximately 0.080 of an inch to approximately 0.150 of an inch and permits the length 115 between the tip 113 of the electrode means 101 and the side 109 of the top portion 74 to vary from approximately 0.187 of an inch to approximately 0.275 of an inch without noticeable performance deterioration in both the ignition and rectification performances thereof.

Therefore, it can be seen that it is a relatively simple method of this invention to form the igniter assembly 59 of this invention to be disposed in the burner construction 20 by the method previously set forth to function as a spark electrode means by merely interconnecting a suitable electrical lead of a spark module to the flattened end 103C of the electrode means 101 in a manner conventional in the art so as to cause sparking in the gap 112 between the tip 113 of the electrode means 101 and the cap means 29.

In one working embodiment of this invention, the intermediate portion 71 of the body member 100 has the distance between the angled sides 76 at the side 77 thereof of approximately 0.312 of an inch with the sides 76 angling toward each other as they approach the side 75 at an angle of approximately 14.5°.

The body member 100 in such one working embodiment has the groove or slot means 78 in the top portion 74 thereof with a width of approximately 0.055 of an inch and a depth of approximately 0.062 of an inch with the groove being formed with a radius of approximately 0.055 of an inch and being approximately 0.300 of an inch long.

However, it is to be understood that such dimensions of the various parts of the igniter assembly 59 of this invention as previously set forth are not to be a limitation on this invention as it is believed that other dimensions can be utilized depending upon various fuel flow rates, pressures, etc.

Thus, it can be seen that this invention not only provides a new burner construction and a new igniter assembly for such a burner construction, but also this invention provides new methods of making such a burner construction and such an igniter assembly.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a method of making a burner construction comprising a burner body means and said burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cap means having an annular surface means cooperating with said annular surface means of said body means to close said groove means on one end thereof whereby said groove means define said port means, said body means having an igniter receiving slot means therein, and an igniter assembly having a part thereof disposed in said slot means, said igniter assembly comprising an electrically insulating member having an intermediate portion and having opposed end surface means one of which is disposed adjacent said cap means, and an electrically conductive L-shaped electrode means carried by said body member and having two legs one of which extends out of said intermediate portion thereof for sparking to said cap means and the other of which extends out of the other of said opposed end surface means of said insulating body member for electrical connection purposes, the improvement comprising the steps of forming said body member to comprise a one-piece member, forming said two legs of said electrode means to initially comprise two separate parts, disposing said two legs so as to respectively have end means thereof adjacent each other in said body member, and then securing said adjacent end means together inside said body member.

2. In a method of making an igniter assembly for a burner body means and said burner body means having a chamber means therein and having opposed end means one of which is open to said chamber means and the other of which has means for interconnecting a source of fuel to said chamber means, and a removable cap means closing said one end means of said body means, said burner construction having port means interconnecting said chamber means to the exterior of said burner construction and through which said fuel can issue to burn externally to said burner construction, said body means having an annular surface means interrupted by a plurality of radially disposed groove means that are spaced apart by land means of said annular surface means, said cap means having an annular surface means cooperating with said annular surface means of said body means to close said groove means on one end thereof whereby said groove means define said port means, said body means having an igniter receiving slot means therein, an igniter assembly adapted to have a part thereof disposed in said slot means, said igniter assembly comprising an electrically insulating body member having an intermediate portion and having opposed end surface means one of which is adapted to be disposed adjacent said cap means, and an electrically conductive L-shaped electrode means carried by said body member and having two legs one of which extends out of said intermediate portion thereof for sparking to said cap means and the other of which extends out of the other of said opposed end surface means of said insulating body member for electrical connection purposes, the improvement comprising the steps of forming said body member to comprise a one-piece member, forming said two legs of said electrode means to initially comprise two separate parts, disposing said two legs so as to respectively have end means thereof adjacent each other in said body member, and then securing said adjacent end means together inside said body member.

3. The method of making an igniter assembly as in claim 1 wherein the step of securing adjacent end means of said electrode means comprises resistance welding said adjacent end means.

4. The method of making an igniter assembly as in claim 2 wherein the step of securing adjacent end means of said electrode means comprises resistance welding said adjacent end means.

* * * * *